US009352610B2

(12) United States Patent
Fahy et al.

(10) Patent No.: US 9,352,610 B2
(45) Date of Patent: May 31, 2016

(54) PAINT TOOL CLEANING APPARATUS

(75) Inventors: Patrick Fahy, Laytown (IE); Hugh O'Donoghue, Laytown (IE)

(73) Assignee: ALVERNO ECO PRODUCTS LIMITED, Laytown (IE)

( * ) Notice: Subject to any disclaimer, the term of this patent is extended or adjusted under 35 U.S.C. 154(b) by 400 days.

(21) Appl. No.: 13/992,264

(22) PCT Filed: Dec. 5, 2011

(86) PCT No.: PCT/IB2011/002972

§ 371 (c)(1), (2), (4) Date: Jun. 7, 2013

(87) PCT Pub. No.: WO2012/076969

PCT Pub. Date: Jun. 14, 2012

(65) Prior Publication Data

US 2013/0276836 A1 Oct. 24, 2013

(30) Foreign Application Priority Data

Dec. 9, 2010 (GB) ..... 1020902.1

(51) Int. Cl.

| | |
|---|---|
| ***B08B 9/20*** | (2006.01) |
| ***B44D 3/00*** | (2006.01) |
| ***A46B 17/06*** | (2006.01) |

(52) U.S. Cl.

CPC ..... *B44D 3/006* (2013.01); *A46B 17/06* (2013.01)

(58) Field of Classification Search

None

See application file for complete search history.

(56) References Cited

U.S. PATENT DOCUMENTS

| | | | | |
|---|---|---|---|---|
| 5,645,091 | A | 7/1997 | Hoeft | 134/84 |
| 6,193,080 | B1 | 2/2001 | Castillo | 211/66 |

FOREIGN PATENT DOCUMENTS

| | | | | |
|---|---|---|---|---|
| CA | 2120974 | | 10/1995 | B05C 21/00 |
| DE | 199 13 840 | C1 | 12/2000 | B44D 3/00 |
| DE | 19913840 | C1 * | 12/2000 | B44D 3/006 |
| FR | 2 869 261 | | 10/2005 | B44D 3/12 |
| FR | 2869261 | A1 * | 10/2005 | B44D 3/006 |
| GB | 2 072 001 | | 9/1981 | B44D 3/00 |

OTHER PUBLICATIONS

International Search Report for International Application No. PCT/182011/002972, Dec. 12, 2012.

* cited by examiner

*Primary Examiner* — Eric Golightly
(74) *Attorney, Agent, or Firm* — Pearne & Gordon LLP

(57) ABSTRACT

An apparatus for cleaning paint roller sleeves comprises an open top drum (2) having a base and side walls for holding a quantity of liquid; a detachable cover (3) for sealing said open top drum; and a removable section (11) comprising a plurality of vertical substantially cylindrical compartments (12) for receiving paint roller sleeves and having a central vertical substantially cylindrical compartment (14). The base of the removable section is positioned above the base of the drum.

21 Claims, 16 Drawing Sheets

PAINT TOOL CLEANING APPARATUS

FIELD OF THE INVENTION

The invention relates to a paint tool cleaning apparatus for cleaning a plurality of paint roller sleeves.

BACKGROUND OF THE INVENTION

Various attempts have been made to make the cleaning of paint roller sleeves and paint brushes less arduous. French Patent application FR2869261 describes a cleaning device for cleaning a brush and a roller with a large number of tubes which are submerged in a cleaning liquid. Canadian Patent Application No. CA 2120974 describes a device to clean paint roller pads by submerging the pads in a solvent bath comprising a raised grill like base upon which is mounted a plurality of upright posts. U.S. Pat. No. 5,645,091 describes an apparatus for soaking and preserving several paint roller covers in wet suspension in a receptacle comprising a rack on which several easily removable paint roller covers are positioned in spaced relationship. U.S. Pat. No. 6,193,080 describes a support for suspending a plurality of paint brushes in a solvent filled bucket. One or more hooks or special carriers suspended from the hooks hold a paint brush by its handle or paint roller above the bottom of the bucket.

While the above mentioned inventions address some of the problems faced when cleaning paint roller sleeves or paint brushes there is a clear need for an improved apparatus which is more user friendly and overcomes the disadvantages of the above inventions.

SUMMARY OF THE INVENTION

According to the invention there is provided an apparatus for cleaning paint roller sleeves comprising;

- an open top drum having a base and side walls for holding a quantity of liquid;
- a detachable cover for sealing said open top drum; and
- a removable section comprising a plurality of vertical substantially cylindrical compartments for receiving paint roller sleeves and having a central vertical substantially cylindrical compartment.

In one embodiment of the invention the base of the removable section is positioned above the base of the drum.

In one embodiment of the invention the cylindrical compartments comprise a grid-like or perforated base.

In another embodiment of the invention the central cylindrical compartment is independent of the other cylindrical compartments. Preferably the central cylindrical compartment is higher in height than the other cylindrical compartments of the removable section.

In one embodiment of the invention the detachable cover comprises retaining means for retaining paint roller sleeves in the cylindrical compartments immersed in liquid. Most preferably the retaining means comprises a collar or flange projecting from the base of the detachable cover.

In one embodiment of the invention the retaining means comprises a detachable retaining member.

In one embodiment of the invention the base of the removable section comprises legs wherein the base of the removable section is positioned above the base of the drum.

In another embodiment of the invention the base of the open top drum is recessed providing a ledge on the inner side of the drum for supporting the removable section above the base of the drum.

In one embodiment of the invention the vertical compartments are sized to accommodate a paint roller sleeve and are longer in length than a paint roller sleeve.

In one embodiment of the invention the removable section comprises a handle for inserting and removing the section from the drum and wherein the handle is not in contact with the liquid contained in the drum.

In one embodiment of the invention the detachable cover comprises means for securing the cover to the drum. Preferably the detachable cover is secured to the drum by a snap on connector.

In one embodiment of the invention the apparatus is portable. Preferably the apparatus as comprises handle means for lifting and transporting the apparatus.

In one embodiment of the invention the apparatus comprises caster wheels on the base of the drum.

In one embodiment of the invention the central cylindrical compartment comprises a protruding lip on its upper edge for pulling the central compartment into an extended position. Preferably the central cylindrical compartment comprises means to releasably attach the central compartment to the other cylindrical compartments when in its extended position. Most preferably the central cylindrical compartment comprises clips at its lower end which clip onto the upper edge of an outer compartments.

In one embodiment of the invention the central cylindrical compartment is telescopic. Preferably the central cylindrical compartment comprises an inner and outer sleeve. Most preferably the inner sleeve of the central vertical compartment is extendable to a working position.

In one embodiment of the invention the inner sleeve of the central vertical compartment comprises a protruding nib. Preferably the outer sleeve of the central vertical compartment comprises a groove for receiving the protruding nib on the inner sleeve guiding the inner sleeve from a resting position to an extended working position.

In one embodiment of the invention the drum comprises a drain outlet. Preferably the drain outlet comprises a bung or stopper. Most preferably a threaded bung or stopper.

In one embodiment of the invention the drain outlet is located on or near the base of the drum. Most preferably the drain outlet is located in the roof of the recess on the base of the drum.

In one embodiment of the invention the drum comprises a viewing port. Preferably the viewing port is below the level of the drain outlet.

According to the invention there is also provided an apparatus comprising;

- an open top drum having a base and side walls for holding a quantity of liquid;
- a detachable cover for sealing said open top drum; and
- a removable section comprising a grid-like base supporting a detachable inverted substantially U shaped bar, the horizontal part of the bar comprising a plurality of engaging means for embracing the stem of a paint brush.

In one embodiment of the invention the horizontal part of the bar of the removable section is not immersed in cleaning liquid. Most preferably the grid-like base of the removable section is positioned above the base of the drum.

According to the invention there is also provided method for cleaning paint soaked roller sleeves using an apparatus of the invention comprising the steps of;

- inserting paint laden roller sleeves into the vertical cylindrical compartments of the removable section;
- filling the drum with sufficient cleaning liquid;
- immersing the removable section in the cleaning liquid;
- securing the detachable cover to the drum;

leaving the roller sleeves for several hours in the drum to allow the paint to drop off the roller sleeves through the grid-like base of the removable section and sediment at the bottom of the drum;

removing the detachable cover; and removing the clean roller sleeves from the vertical compartments.

In one embodiment of the invention a clean roller sleeve is spun dry in the central vertical compartment when in its extended working position. Preferably the clean roller sleeve is spun dry in the central compartment using a conventional roller sleeve spinner. Most preferably the liquid spun off the roller sleeve is retained in the drum.

BRIEF DESCRIPTION OF THE INVENTION

The invention will be more clearly understood from the following description thereof with reference to the accompanying drawings in which.

DESCRIPTION OF THE INVENTION

Figure 2:
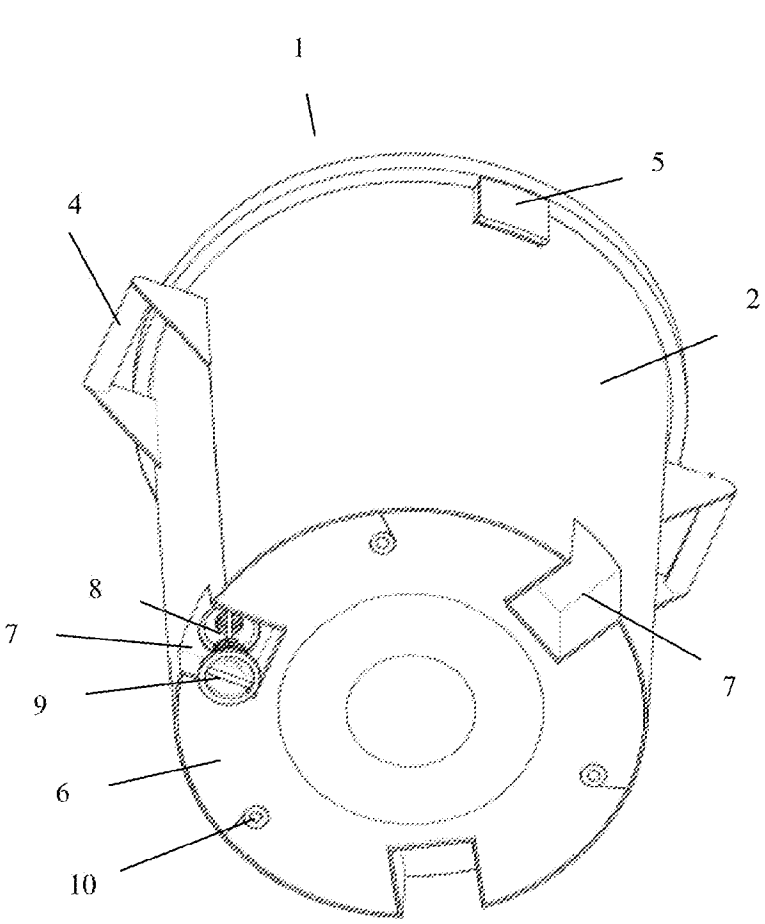
FIG. 2 is a perspective view from underneath the paint roller cleaning apparatus of FIG. 1.

For ease of description the term paint roller sleeve has been used to describe the part of a paint roller that retains paint. Other terms to describe a paint roller sleeve such as slim jirns, skins, pads or covers are intended to be included in the term roller sleeve.

Cleaning paint roller sleeves is a time consuming, messy and laborious task. While the cost of paint roller sleeves has decreased over the years, when carrying out any sizeable painting job a lot of roller sleeves are required and being able to reuse roller sleeves a number of times is very desirable. Even for a domestic household it is a real chore to efficiently clean a single paint roller sleeve for use with a different paint colour or for storing for use at a later date.

The present invention provides a paint roller sleeve cleaning apparatus which prolongs the life-span of paint roller sleeves and makes the task of cleaning a paint roller sleeve less arduous. The paint roller sleeve cleaning apparatus of the invention provides a cost effective, less labour intensive and efficient means to clean used paint roller sleeves ready for use at another time. For the commercial painter the apparatus of the present invention saves a lot of man hours and eliminates the hassle normally associated with cleaning paint rollers at the end of a busy day.

In addition the apparatus of the present invention provides a system which is more environmentally friendly. In many countries the disposal of cleaning solutions from cleaning paint rollers and brushes requires strict regulations to be met. Water contaminated with paint or solvent based solutions cannot simply be rinsed down the drain. In addition the amount of water required to rinse a single roller sleeve and remove all trace of paint can be up to 120 liters. Water is a precious resource and the apparatus of the present invention is capable of cleaning up to 18 roller sleeves using approximately 30 liters of water. The apparatus of the present invention provides a painter with a simple and labour saving cleaning method which also allows the painter to more easily adhere to the required regulations.

The paint roller cleaning apparatus of the present invention comprises a watertight drum or container which can hold a plurality of paint roller sleeves at any one time. The apparatus of the invention is designed to accommodate any size of standard commercially available paint roller sleeve. Different sized roller sleeves may be cleaned at the same time. Used paint laden roller sleeves are inserted into the apparatus of the invention and over a number of hours the paint passively falls off the roller sleeves and gathers/sediments in the form of paint sludge at the bottom of the drum. Submerged in a thinning or cleaning liquid, water for water based paints or a solvent cleaner for solvent based paints, the water or solvent breaks down the paint on the roller sleeves into liquid particles and solid particles. The heavier solid particles sediment at the bottom of the drum or container. The combination of separation and gravity results in removing paint from the paint roller sleeves leaving clean paint roller sleeves for re-use.

The painter may then simply remove the clean roller sleeves, spin the sleeves dry using a conventional spinner device in combination with the apparatus of the invention to remove excess water or solvent. The paint roller sleeve is then ready for re-use or storage for future use. Without a lot of time or effort using the paint roller apparatus of the present invention a painter has clean roller sleeves ready for re-use.

Figure 1:
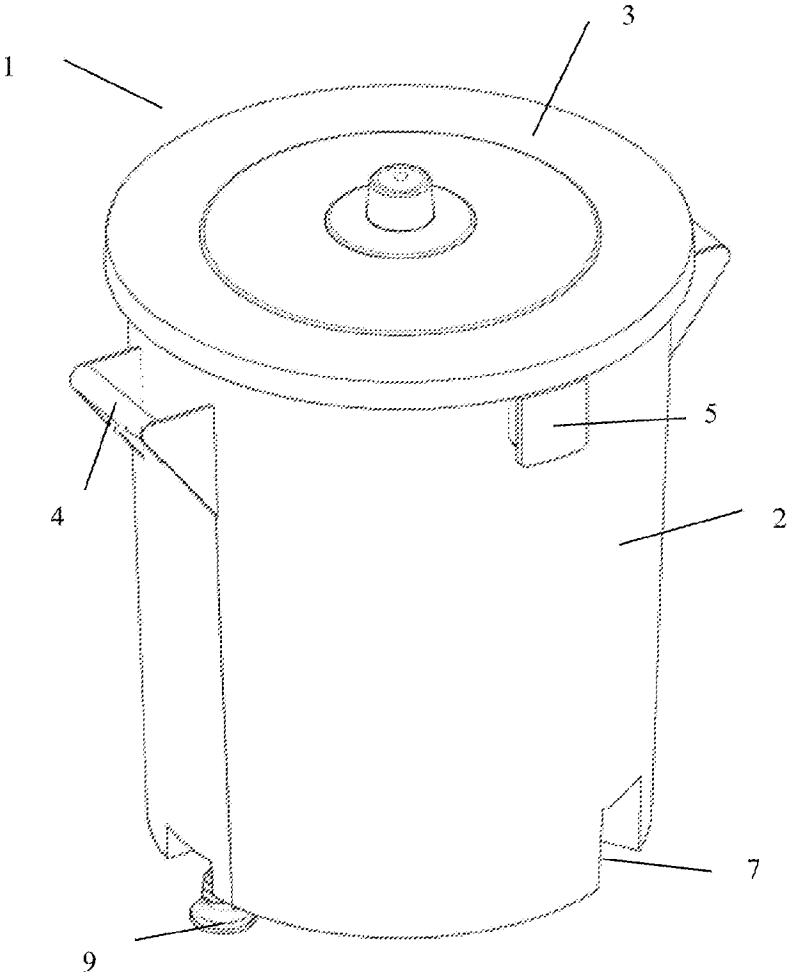
FIG. 1 is a side perspective view of a paint roller cleaning apparatus of the invention.

FIG. 1 shows a paint roller cleaning apparatus 1 of the invention. The apparatus 1 comprises a watertight drum or container 2 and a cover section 3. The apparatus is portable and transportable and comprises handles 4 for ease of lifting the unit. The cover section 3 is secured to the drum 2 by a snap on connector 5. This is a conventional snap on connector for securely attaching the cover 3 to the drum 2. The snap on connector is easily released to remove the cover 3 from the drum 2.

The base 6 of the watertight drum 2 comprises a number of recesses 7. As shown in FIG. 2 a drain outlet 8 is located in the roof or top of one of the recesses 7. The drain outlet 8 comprises a threaded stopper or bung 9 which controls the flow of liquid through the drain outlet 8. Opening the bung 9 allows the cleaning liquid to be drained away without disturbing the sediment gathered on the base 6 of the drum 2.

The threaded stopper or bung 9 preferably comprises a valve for controlling the flow of liquid and by simply twisting the bung the liquid may be released in a controlled way. The stopper or bung does not need to be unscrewed completely for the liquid to fully drain out in a controlled manner into an appropriate container for disposal.

The base 6 of the drum 2 may have caster receiving holes 10 for receiving caster wheels. In this way the apparatus 1 may be easily and safely rolled from place to place without having to lift a heavy drum full of cleaning liquid.

Figure 4:
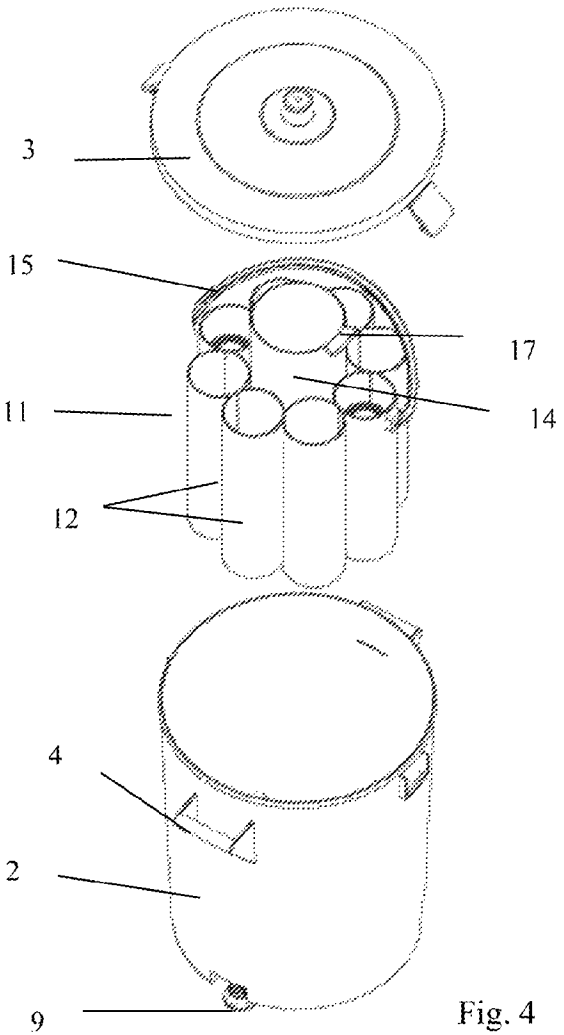
FIG. 4 is an exploded view of the paint roller cleaning apparatus of FIG. 1.
Figure 3:
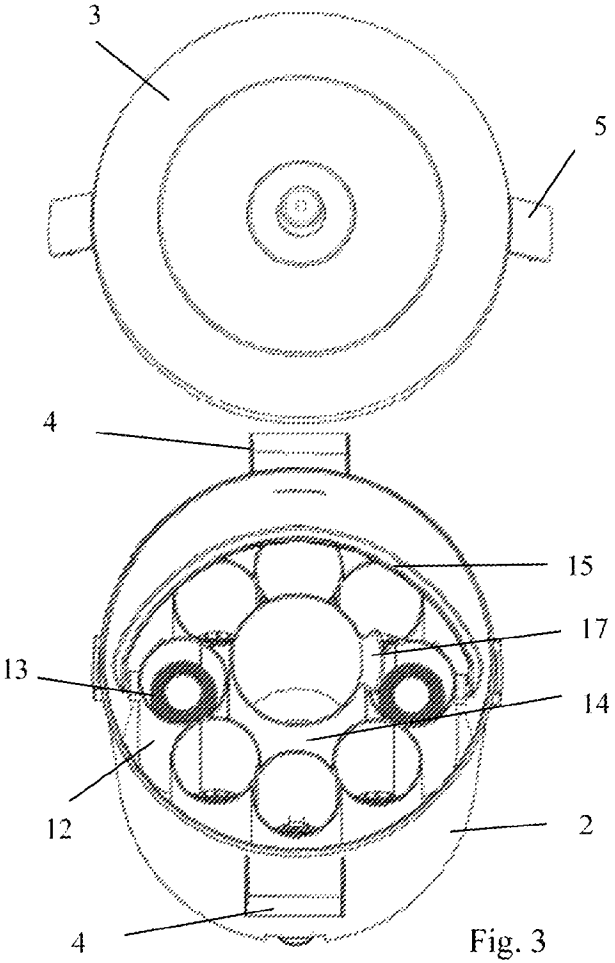
FIG. 3 is a top perspective view of the paint roller cleaning apparatus of FIG. 1 showing the drum or container, removable cover and removable section.

The apparatus 1 comprises a removable section 11 as shown in FIGS. 3 and 4. The removable section 11 comprises a plurality of contiguous vertical substantially cylindrical compartments 12 into which paint roller sleeves 13 are inserted. The contiguous cylindrical compartments 12 surround a central vertical substantially cylindrical compartment 14. The central cylindrical compartment 14 is slightly longer and wider in diameter than the outer cylindrical compartments 12.

The separate compartments mean that the liquid in the drum is not significantly disturbed when inserting or removing a roller sleeve 13 from any one of the compartments 12, 14. As a result the disturbance of the paint sludge which has sedimented at the bottom of the drum is minimised and consequently the cleaning time of the roller sleeves is reduced. In addition roller sleeves with different colour paint on them may be cleaned at the same time without the risk of paint rubbing off one sleeve onto another sleeve when inserting the sleeves into the compartments. The removable section 11 has a handle 15 for lifting the section 11 in and out of the drum 2.

Figure 8:
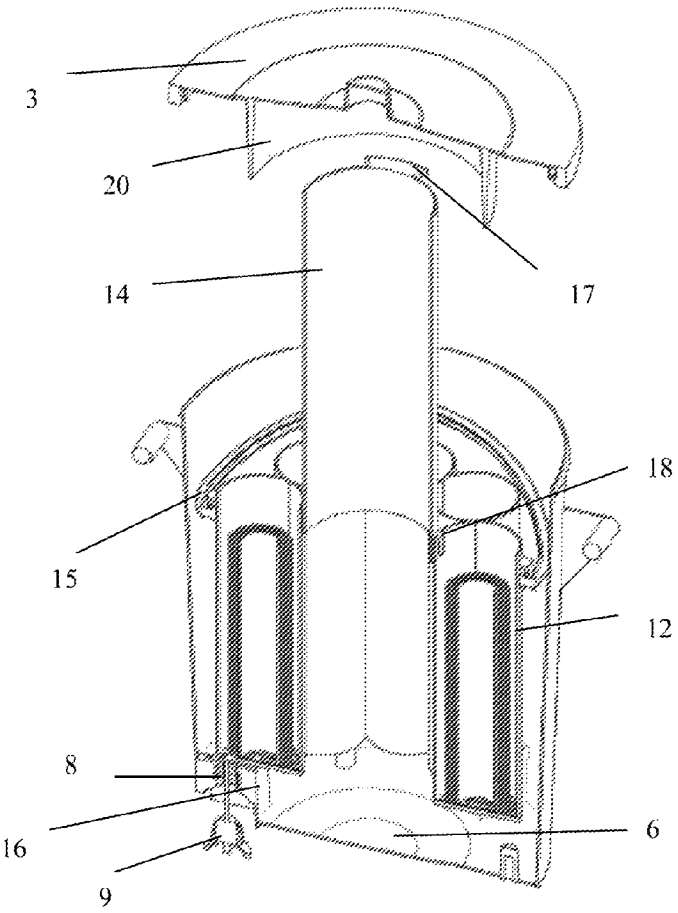
FIG. 8 is a partial cross sectional view of the paint roller cleaning apparatus of FIG. 1 with the cover removed and the central compartment in its extended working position.

The central vertical substantially cylindrical compartment 14 rests between the other vertical compartments 12. The central compartment 14 has a lip 17 at its upper edge for pulling the compartment 14 into an extended position when required as shown in FIG. 8. When in the extended position clips 18 at the lower end of the central compartment 14 rest across the top edge of one or more of the cylindrical compartments 12 keeping the central compartment 14 in its extended position. The central compartment 14 may have a clip near its upper end which rests across an upper edge of one of the outer compartments 12 to hold the central compartment 14 in its resting position within the removable section 11.

Figure 6:
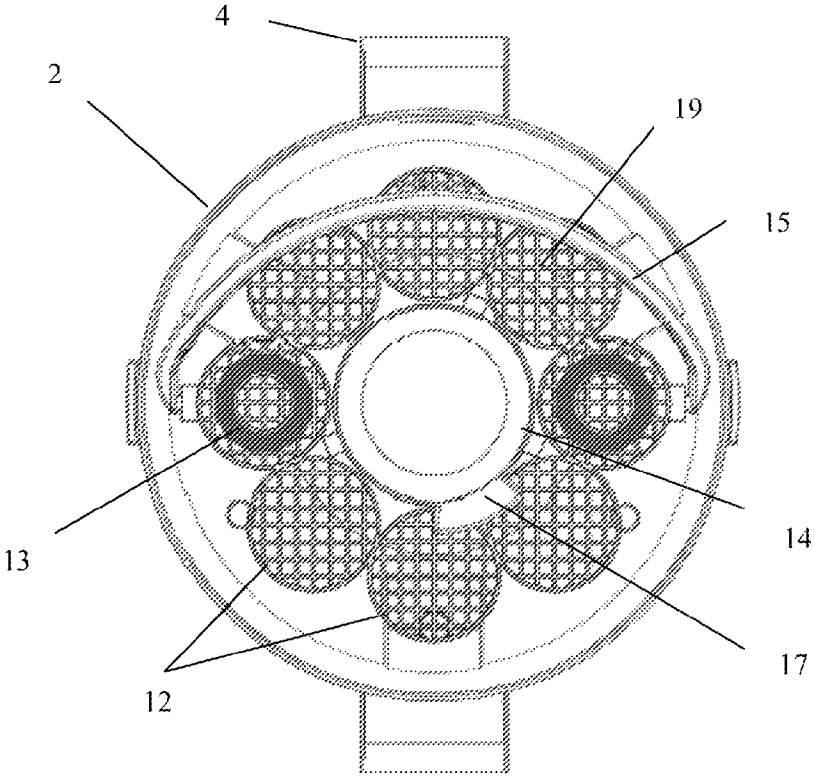
FIG. 6 is a downward view into the drum showing the perforated base of the removable section of the apparatus of FIG. 1.
Figure 5:
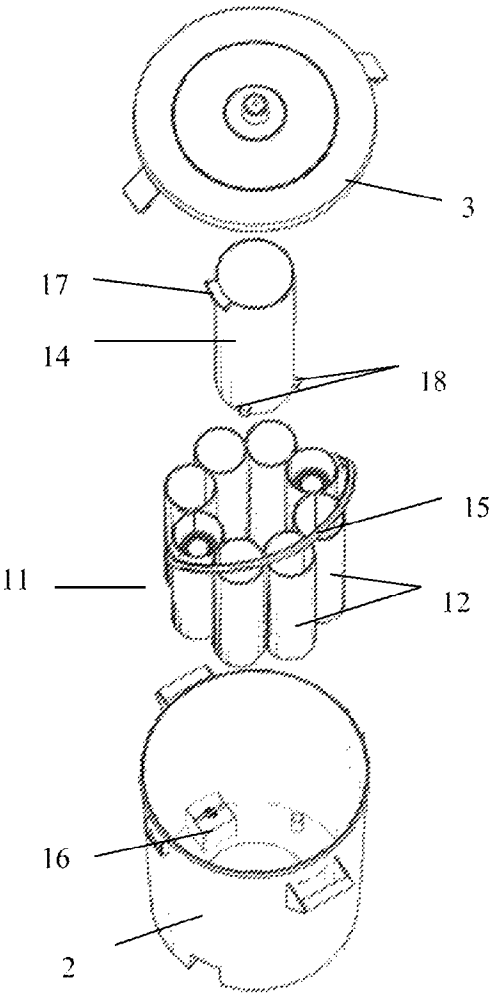
FIG. 5 is an exploded view of the paint roller cleaning apparatus of FIG. 1 showing the four main components of the apparatus.

The base of the vertical compartments 12 of the removable section 11 comprises a perforated or grid-like base 19 as shown in particular in FIG. 6. An additional frame-like base (not shown) criss-crosses across the entire base of the removable section 11 providing a base to the central compartment. Heavy solid paint particles pass through the grid-like base 19 and sediment in the form of paint sludge at the bottom of the drum 2. If necessary an additional paint laden roller sleeve may be inserted into the central compartment 14.

Figure 7:
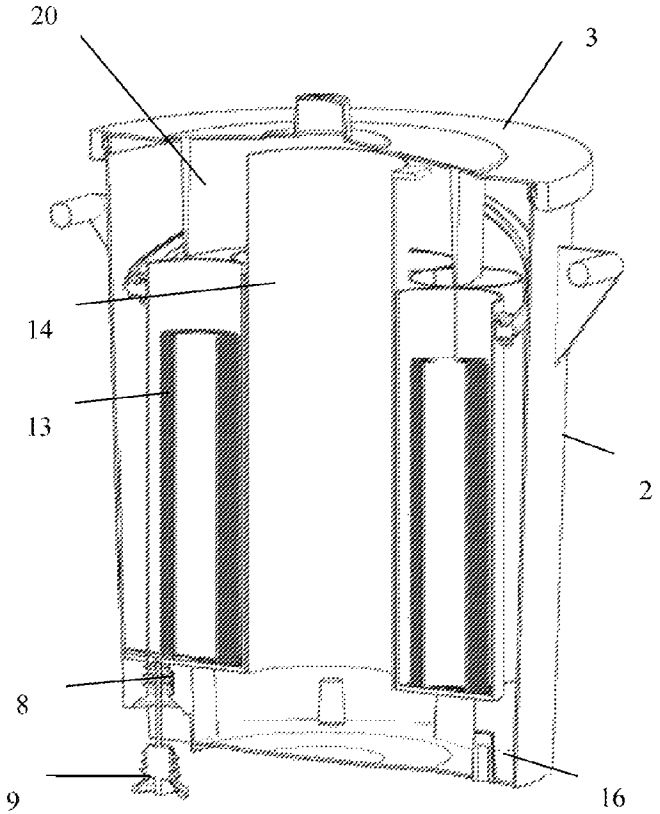
FIG. 7 is a partial cross sectional view of the paint roller cleaning apparatus of FIG. 1 with the cover attached to the drum.

The cover section 3 of the paint roller cleaning apparatus 1 comprises means for retaining the removable section 11 immersed in cleaning liquid. The retaining means comprises a collar or flange 20 projecting downwards from the base of the cover section 3 as shown in FIGS. 7 and 8. When the cover section 3 is secured to the drum 2 the collar 20 on the underside of the cover 3 projects downwards on the outer vertical compartments 12 of the removable section 11. In this way the outer compartments of the removable section 11 and any roller sleeves contained therein are kept immersed in the cleaning liquid.

As shown in FIGS. 7 and 8 the removable section 11 rests on a ledge or platform 16 resulting from the recesses 7 in the base of the drum 2. In this way the removable section 11 is positioned away from the base of the drum 2. The cleaning liquid may be drained out through the outlet drain to the level of the platform leaving the paint sludge gathered on the bottom of the drum undisturbed.

In use paint laden roller sleeves 13 are inserted into the vertical compartments 12 of the removable section 11. The paint laden roller sleeves rest on the grid-like base 19. The removable section 11 is inserted into the drum 2. The removable section 11 rests on the ledges 16 on the base 6 of the drum 2 leaving space between the base of the removable section 11 and the base of the drum 2. Cleaning liquid is added to the drum to a level sufficient to cover the top edge of the cylindrical compartments 12. The cover section 3 is secured to the drum 2 and the outer compartments 12 of the removable section 11 and the roller sleeves 13 are kept immersed in the cleaning liquid by means of the collar 20 pressing down on the outer compartments of the removable section 11

The level of cleaning liquid in the drum must be sufficient to immerse the outer cylindrical compartments 12 however the handle of the removable section 11 and the upper end of the central compartment 14 are ideally kept above and out of the cleaning liquid. In this way the painter never has to come in contact with the cleaning liquid while cleaning the roller sleeves. This is important particularly when stringent cleaning liquids are being used.

Over a number of hours the paint passively falls off the roller sleeves and the heavier solid paint particles pass through the grid like base 19 and sediment in the form of paint sludge at the bottom 6 of the drum 2. The paint sludge gathers at the bottom 6 of the drum 2 and as the removable section is positioned above the bottom of the drum the removable section 11 is not in contact with the sedimented sludge.

Now lighter in weight the clean roller sleeves 13 tend to rise up. However the clean roller sleeves are kept immersed in the cleaning liquid by the retaining collar 20 projecting downwards from the base of the cover section 3 and pressing down on the removable frame. It is important to retain the roller sleeves in liquid and not allow them to dry out. If even a small area of a roller sleeve is exposed to air over a period of time the pile or nap will dry out. A paint roller sleeve with hardened or uneven dry sections is no longer useful to a painter as it results in a non-uniform paint finish.

The clean roller sleeves are spun dry using a conventional roller spinner in combination with the central compartment 14 in its extended position. Any commercially available paint roller spinner may be used. The central compartment 14 is brought to its extended position by pulling on lip 17 on the upper edge of the compartment 14. The compartment 14 is kept in its extended position by the clips 18 which clip onto the upper rim of one or more of the outer compartments 12 holding the central compartment in an extended position as shown in FIG. 8.

Using a roller spinner a clean but wet roller sleeve is removed from an outer compartment 12 to the extended central compartment 14. The roller spinner is attached to the end of the roller sleeve and the sleeve removed from the outer compartment 12 to the extended central compartment. In this way the painter's hands do not need to come into contact with the cleaning liquid in the drum 2. The elongated position of the central compartment 14 ensures that the clean roller sleeve is kept out of the cleaning liquid in the drum 2. Using the spinner the roller sleeve is spun dry. The liquid spun off the roller sleeve is contained by the walls of the central compartment 14 and the liquid drains down into the drum 2. A clean roller sleeve may be spun dry without all the mess typically associated with spinning a roller sleeve dry. The paint roller sleeve is then ready for reuse or storage for future use. The extended central compartment 14 ensures that while spinning the roller sleeve dry there is minimal disturbance to the paint sludge gathered at the bottom of the drum 2.

After cleaning a number of roller sleeves the liquid in the drum will need to be changed and the paint sludge gathered or sedimented at the bottom of the drum removed. Typically a painter will know that after cleaning a given number of roller sleeves the cleaning liquid will need to be changed and the sediment at the bottom of the drum removed in order to maintain an efficient cleaning system. When the removable section 11 is removed from the drum it is easy to assess the level of sludge on the bottom of the drum.

Using the apparatus of the present invention with water based paints having water as the liquid in the drum, it has been found that up to 16 roller sleeves may be cleaned before the water needs to be changed and the sludge removed. The drum holds approximately 30 liters of water. Therefore up to 16 roller sleeves may be cleaned in a relatively small volume of water. Conventionally to clean a single paint roller sleeve by washing and rinsing down a drain or sink can use up to 120 liters of water. The paint roller cleaning apparatus of the invention provides a system which saves substantially on water usage. In addition not having to clean and rinse a single paint roller sleeve down a drain or sink has a huge impact environmentally both on the water usage and water contamination.

The cleaning liquid is released from the drum by twisting the bung 9 in the drain outlet 8 and draining the liquid out. The bung allows the liquid to drain out in a controlled manner. Once all the liquid has been drained away the sedimented paint sludge may be scooped out. The drain outlet may have a filter to ensure that all solid paint particles are captured and retained within the drum as the liquid is drained off.

The liquid released may be retained for disposal according to the required environmental regulations. The liquid may be water contaminated with paint or a solvent solution and these liquids need to be disposed of accordingly. The remaining sludge may then be scooped out of the drum 2 and mixed with a hardening agent. When hardened this may simply be disposed of as general waste. Again the hardened sludge should be disposed of according to the required environmental regulations. These regulations vary in different countries.

Preferably the cleaning liquid in the drum is water as it is environmentally desirable that most paints are water based. In Australia for example, solvent based paints are no longer recommended and rarely used. Many other countries are also trying to phase out their use of solvent based paints. Alternatively the cleaning liquid in the drum is a solvent to remove oil based paints. As with water the immersion of the roller sleeve in the solvent over a number of hours promotes the paint dropping off the roller sleeve and falling through the perforated base to gather at the bottom of the drum.

The paint roller cleaning apparatus of the invention provides a very simple and advantageous method of cleaning a plurality of paint roller sleeves in an environmentally friendly way. Using the apparatus of the present invention the painter has a considerably lower volume of contaminated liquid to dispose of and the sludge when mixed with a hardening agent can be disposed of as general waste. Disposing of the cleaning liquid in this way where there is a separate liquid waste and solid waste is very cost effective for the commercial painter. The cost of disposing of contaminated waste is high and the fine for incorrectly disposing contaminated waste is even higher.

FIGS. 9 to 14 show a paint roller apparatus 30 according to another embodiment of the invention. The apparatus 30 is substantially similar to the apparatus 1, and similar components are identified by the same reference numerals. In this embodiment of the invention the drain outlet 8 is located on the side of the drum 2 near the base. Unlike apparatus 1 the drum 2 of apparatus 30 does not have recesses on the base of the drum. A viewing port 21 is located near the base for easy monitoring of sedimented sludge levels without having to disturb the sedimented paint sludge.

Figure 10:
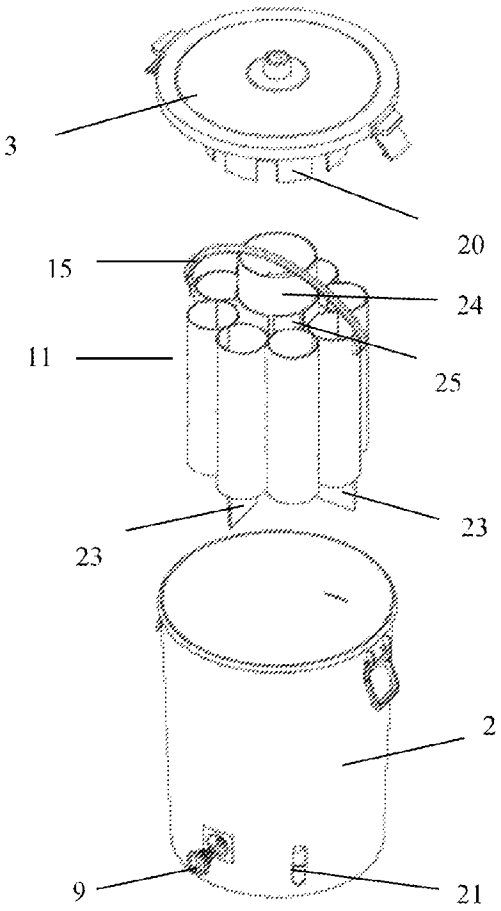
FIG. 10 is an exploded view of the paint roller cleaning apparatus of FIG. 9.
Figure 9:
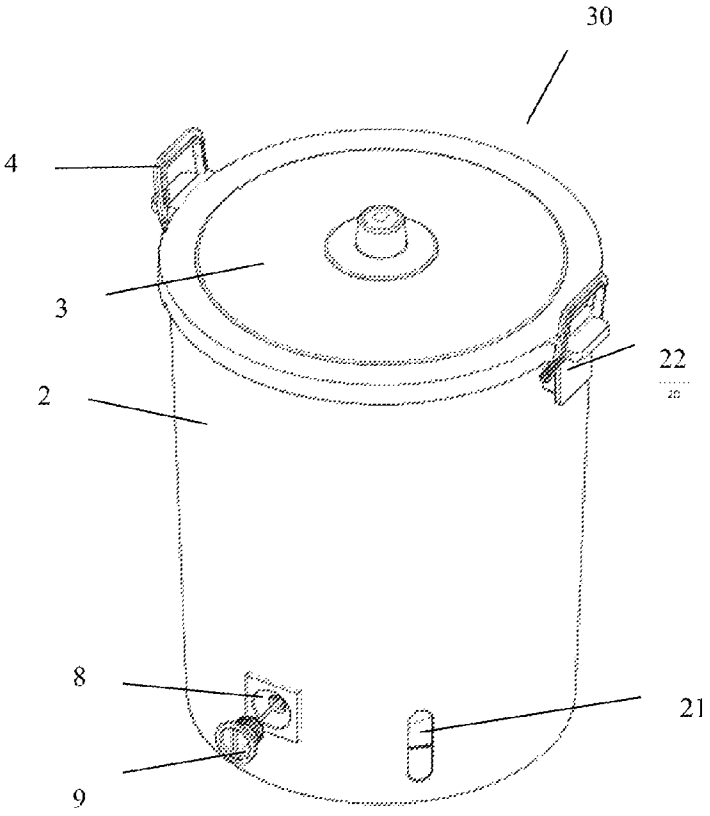
FIG. 9 is a side perspective view of a paint roller cleaning apparatus according to another embodiment of the invention.

As shown in FIG. 10 in this embodiment of the invention the removable section 11 comprises legs 23 which ensures the base of the section 11 rests substantially above the bottom of the drum 2. This allows room for the paint sludge to sediment at the bottom of the drum and not be in contact with the roller sleeves in the removable section. The removable section 11 comprises a handle 15 which enables the section 11 to be easily inserted and removed from the drum 2.

Figure 12:
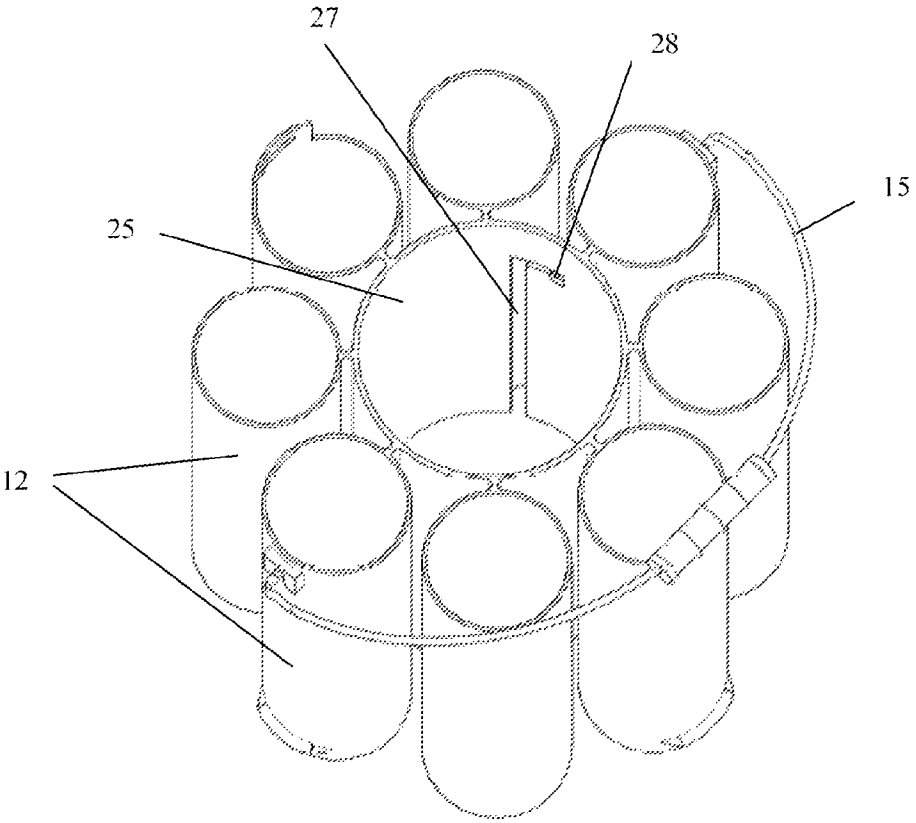
FIG. 12 is a top perspective view of the removable section of the apparatus of FIG. 9 showing the groove along the inner sleeve.
Figure 11:
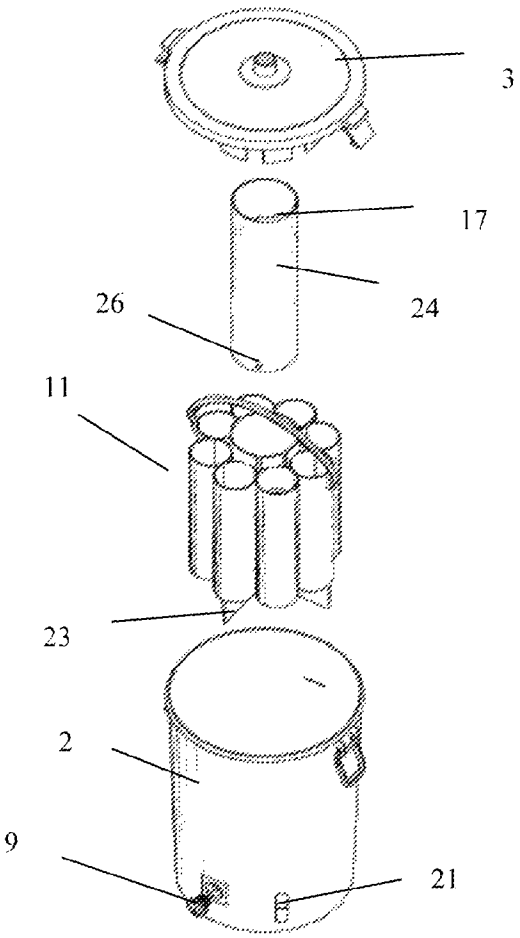
FIG. 11 is an exploded view of the paint roller cleaning apparatus of FIG. 9 showing the four main components of the apparatus.
Figure 13:
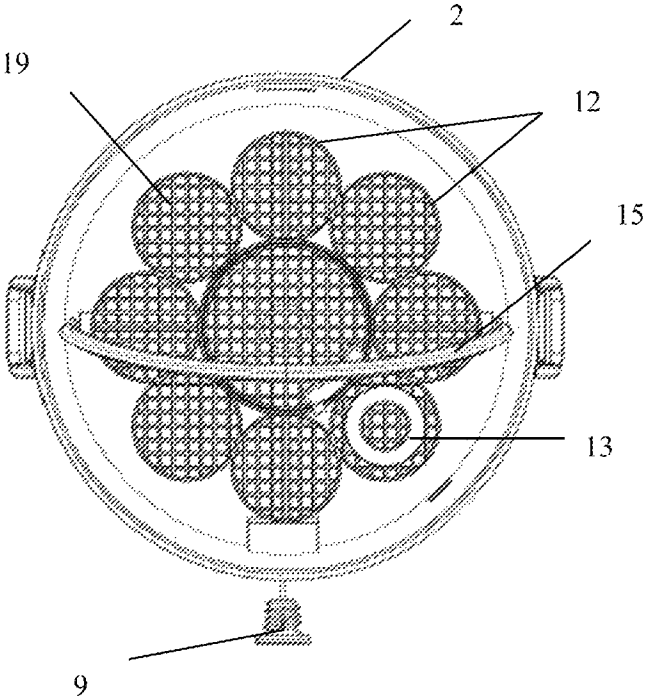
FIG. 13 is a downward view showing the grid-like or perforated base of the removable section of the apparatus of FIG. 9.
Figure 16:
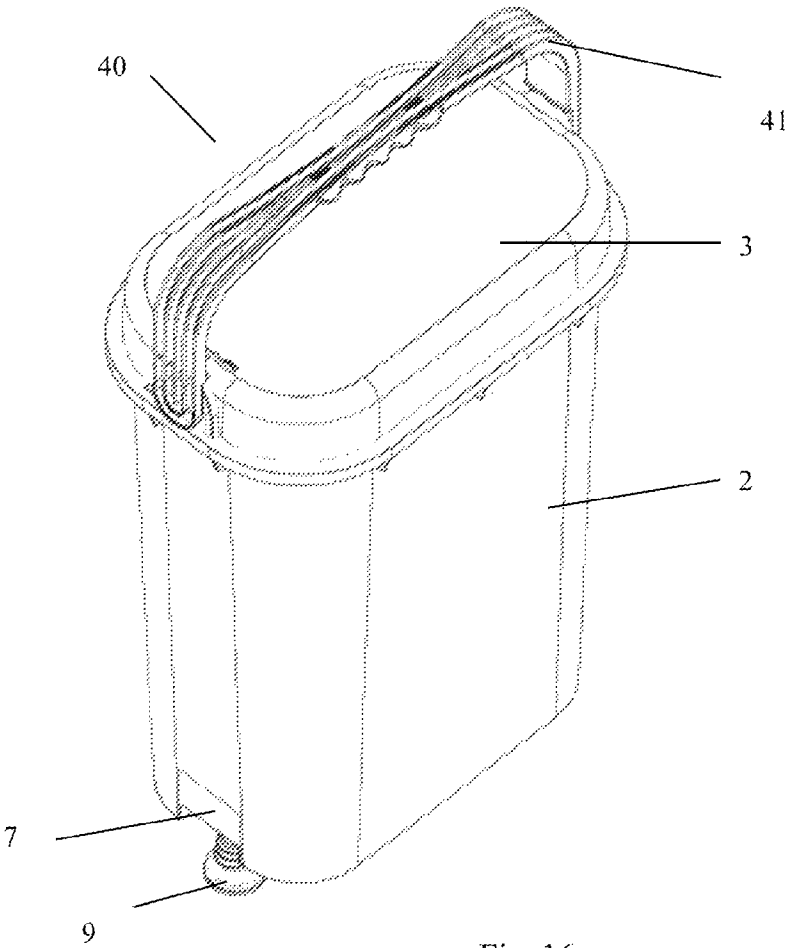
FIG. 16 is a side perspective view of a paint roller cleaning apparatus according to another embodiment of the invention.
Figure 15:
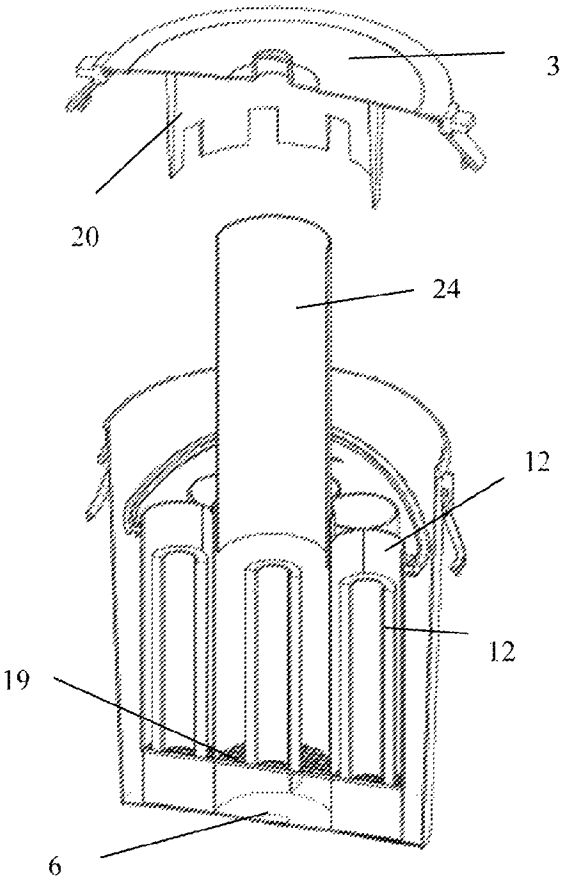
FIG. 15 is a partial cross sectional view of the paint roller cleaning apparatus of FIG. 9 with the cover removed and the central compartment in its extended position.
Figure 18:
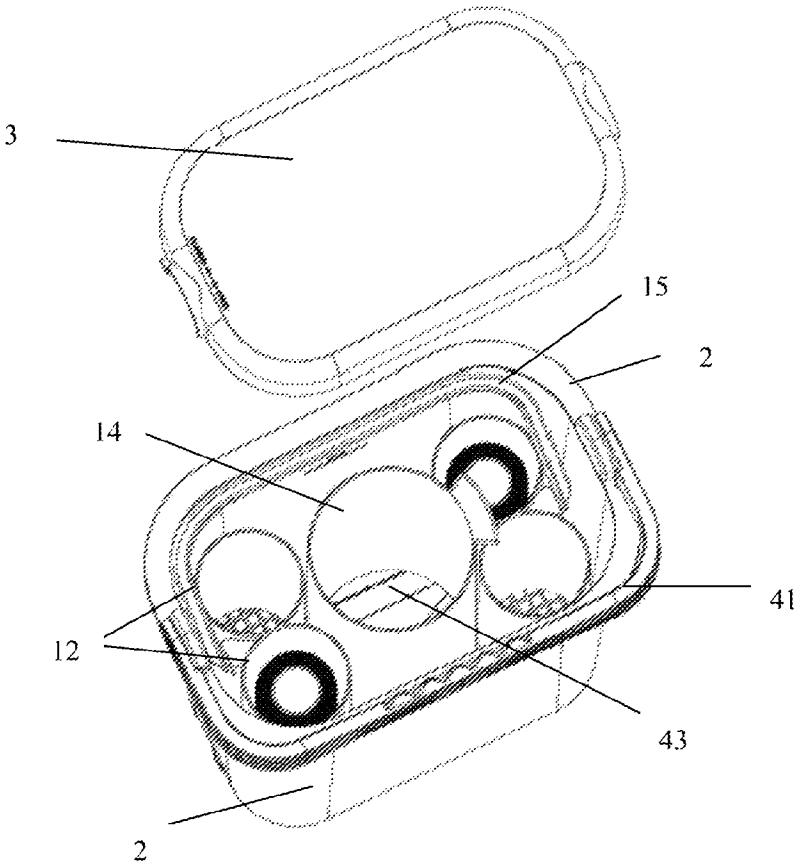
FIG. 18 is a top perspective view of the paint roller cleaning apparatus of FIG. 16 showing inside the container/drum, removable cover and removable section.
Figure 17:
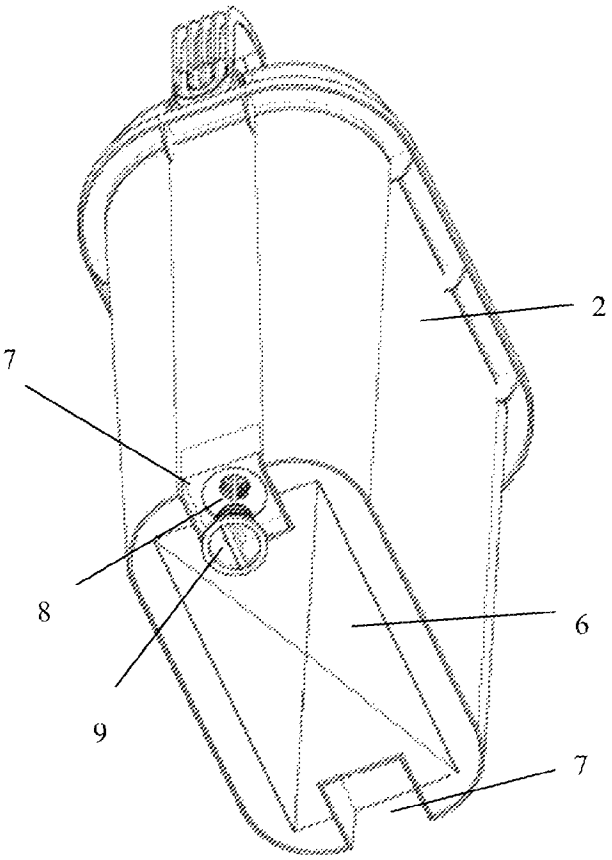
FIG. 17 is a perspective view from underneath the paint roller cleaning apparatus of FIG. 16.
Figure 20:
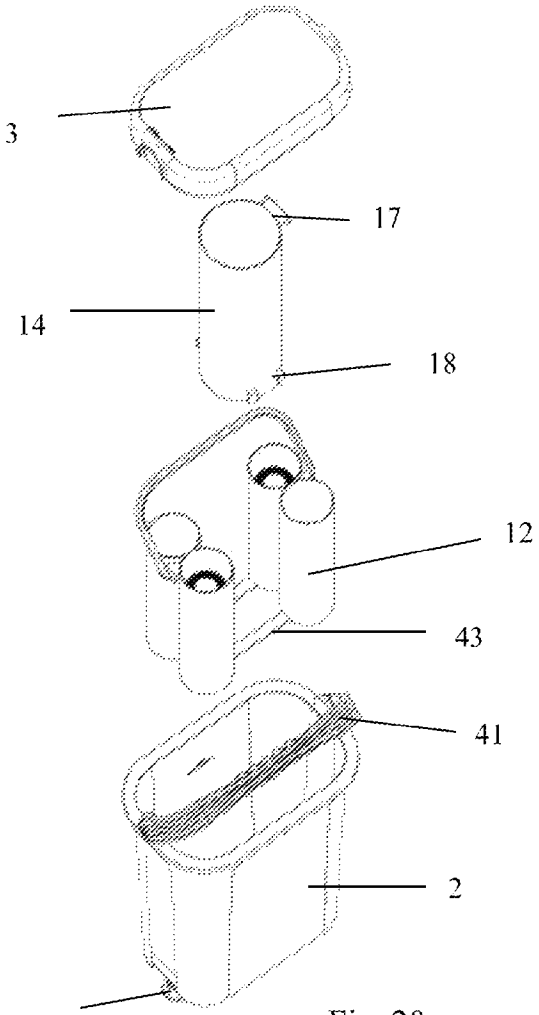
FIG. 20 is an exploded downward view of the paint roller cleaning apparatus of FIG. 16 showing the four main components of the apparatus.
Figure 19:
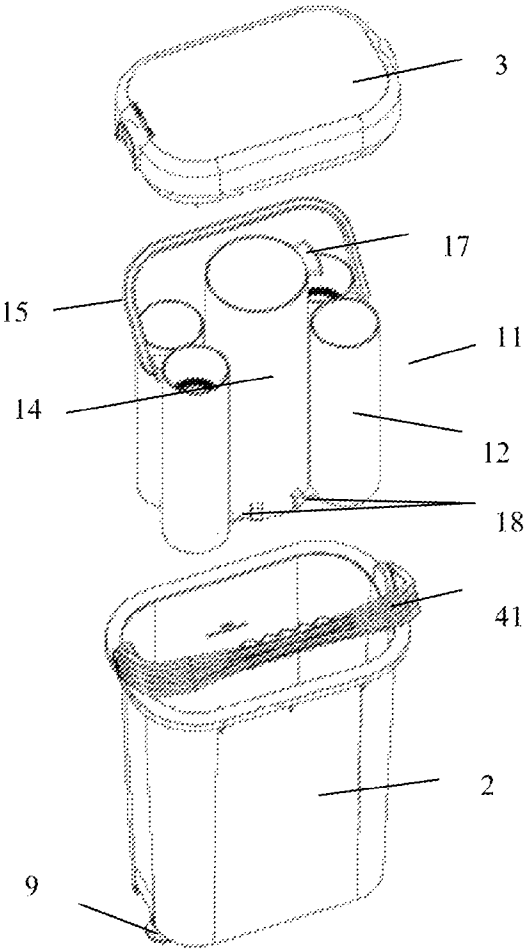
FIG. 19 is an exploded view of the paint roller cleaning apparatus of FIG. 16.
Figure 22:
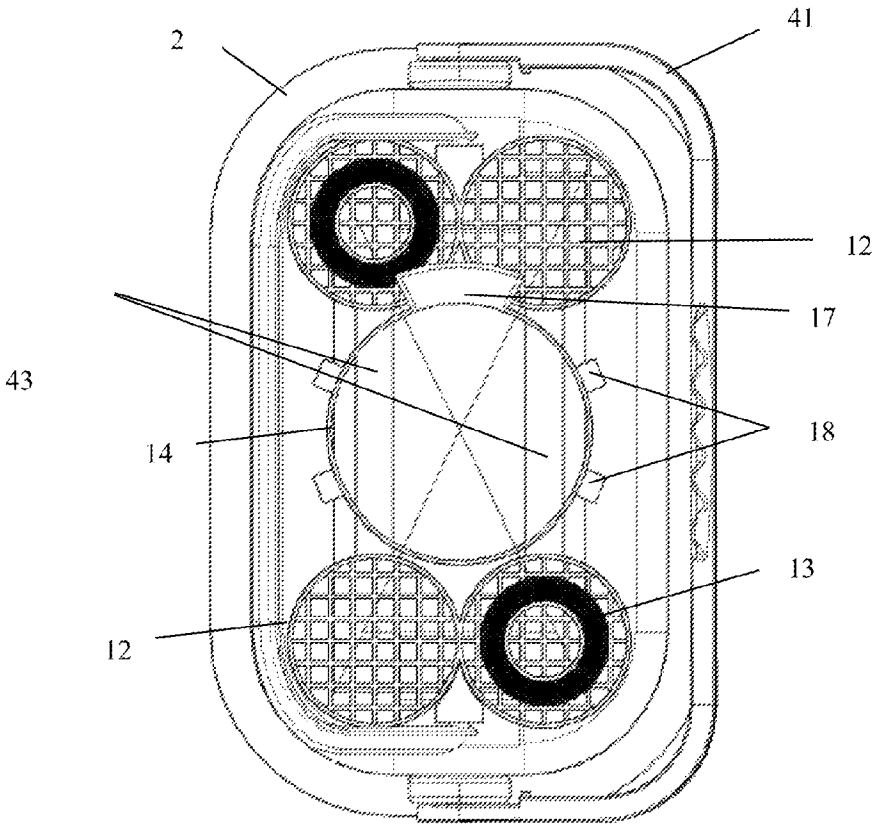
FIG. 22 is a downward view of the inside of the paint roller cleaning apparatus of FIG. 16.

The handles 4 of the apparatus 30 incorporate a clamp 22 for securing the cover/lid 3 to the drum 2. The central compartment is telescopic and comprises an inner 24 and an outer sleeve 25. When required to spin a clean roller sleeve dry the central compartment is extended to an elongated working position by pulling on the lip 17 on the top rim of the inner sleeve 24. The inner sleeve 24 comprises a protruding nib 26 at its lower end which fits within and along a groove 27 on the outer sleeve 25 as shown in FIG. 12. The groove 27 extends substantially vertically along the outer sleeve 25 and near the upper end of the outer sleeve the groove has a slot 28 for receiving nib 26 when the inner sleeve 24 is fully extended to hold the inner sleeve 24 in its extended position. Turning the inner sleeve 24 in the opposite direction nib 26 is released from the slot 28 and the inner sleeve 24 brought back to its resting position within the outer sleeve 25. The inner sleeve 24 may be held in its resting position by turning the inner sleeve 24 so that the nib 26 catches the bottom edge of the outer sleeve. FIG. 13 shows the perforated or grid-like base 19 on the base of the compartments.

Figure 14:
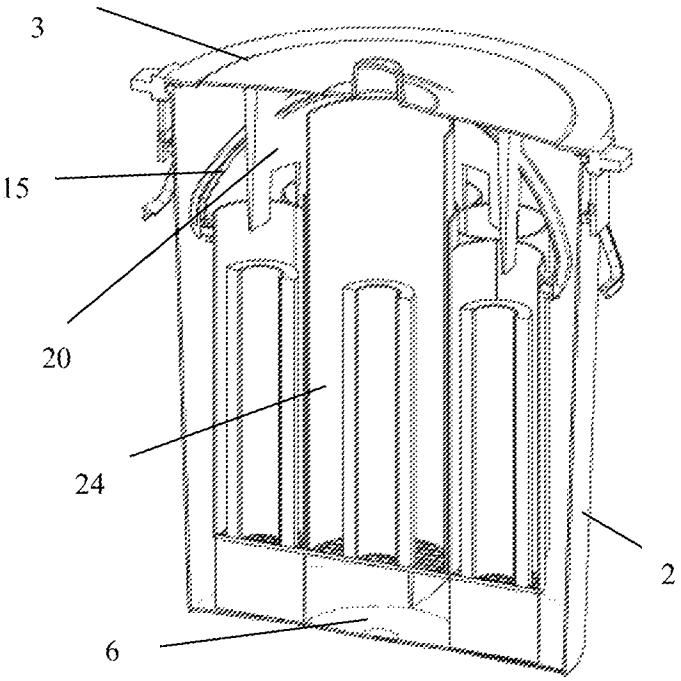
FIG. 14 is a partial cross sectional view of the paint roller cleaning apparatus of FIG. 9 with the cover on and the central compartment in its resting position.

In this embodiment of the invention the retaining means 12 on the underside of the cover 3 comprises a castellated collar 20, however the collar may be smooth edged or any other suitable shape. As shown in FIG. 14 when the cover section 3 is secured to the drum 2 the longer sections of the collar 20 press down on the roller sleeves 13 in the outer compartments 12 and the shorter sections of collar 20 rest across the upper edges of the outer compartments 12 keeping both the roller sleeves and removable section immersed in the cleaning liquid. Clean roller sleeves are spun dry as described above.

FIGS. 16 to 26 show a paint roller apparatus 40 according to another embodiment of the invention. The apparatus 40 of this embodiment is directed toward a painter who cleans a few roller sleeves regularly or the individual DIY painter who may only have a few paint roller sleeves to clean. The apparatus 40 may clean up to 5 roller sleeves at any one time. The apparatus 40 is substantially similar to apparatus' 1 and 30 and similar components are identified by the same reference numerals.

In this embodiment the drum 2 is substantially rectangular in shape with a handle 41 attached to the drum 2. Once the cover 3 is placed on top of the open drum 2, the handle 41 is brought up and over the cover 3 locking and securing the cover 3 to the drum 2. Any other suitable arrangement for attaching the cover section to the drum may be used.

Similar to apparatus 1 the drum 2 has recesses 7 on the base of drum 2. The drain outlet 8 and threaded bung 9 are located in the roof of one of the recesses. The removable section 11 rests on a ledge 16 formed by the recesses 7. As described for apparatus 1 the cleaning liquid may be drained out of the drum 2 by opening the threaded bung 9 and releasing the liquid in a controlled manner through drain outlet 8 without disturbing the paint sludge which has sedimented or gathered on the base 6 of the drum. The remaining paint sludge on the base may be then scooped out.

The removable section 11 comprises four outer compartments 12 and a central compartment 14. The base of the outer compartments has a grid-like or perforated base. Bars 43 between the outer compartments 12 stabilise the removable section 11 and also provide a base to the central compartment 14 which rests between the outer compartments 12.

Figure 21:
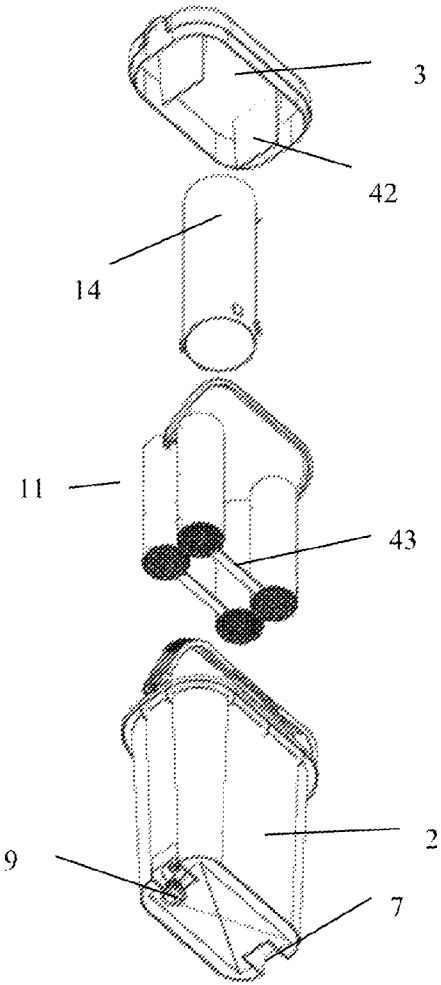
FIG. 21 is an exploded view from underneath the paint roller cleaning apparatus of FIG. 16 showing the four main components.
Figure 24:
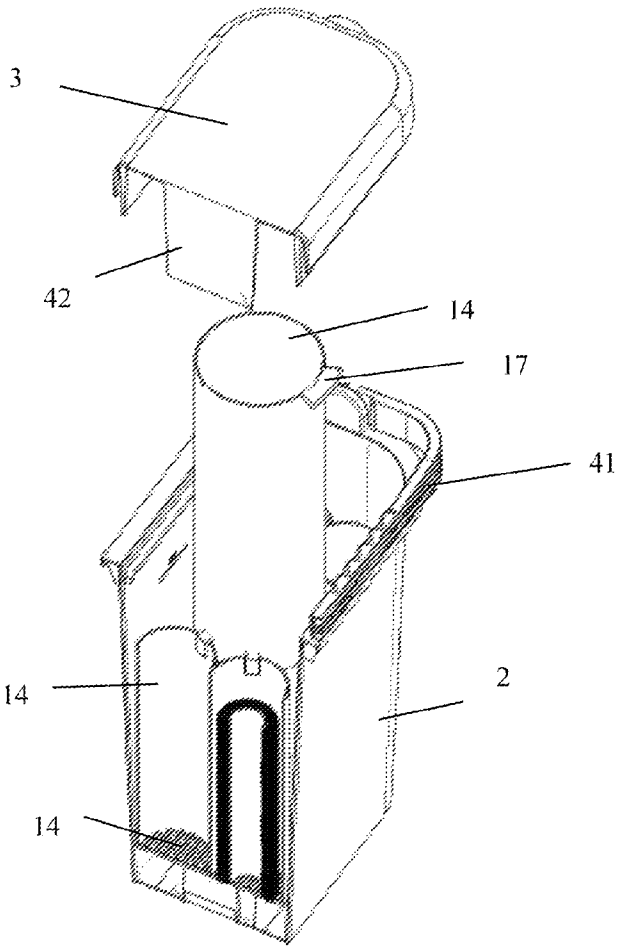
FIG. 24 is a partial cross sectional view through two of the outer compartments of the paint roller cleaning apparatus of FIG. 16 with the cover removed and the central compartment in its extended position.
Figure 23:
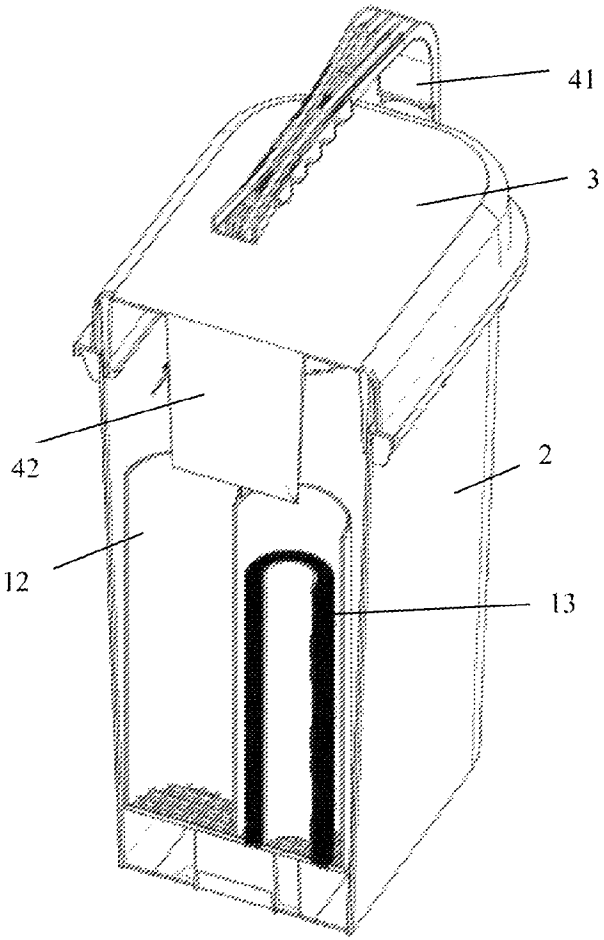
FIG. 23 is a partial cross sectional view through two of the outer compartments of the paint roller cleaning apparatus of FIG. 16 with the cover attached to the drum.
Figure 26:
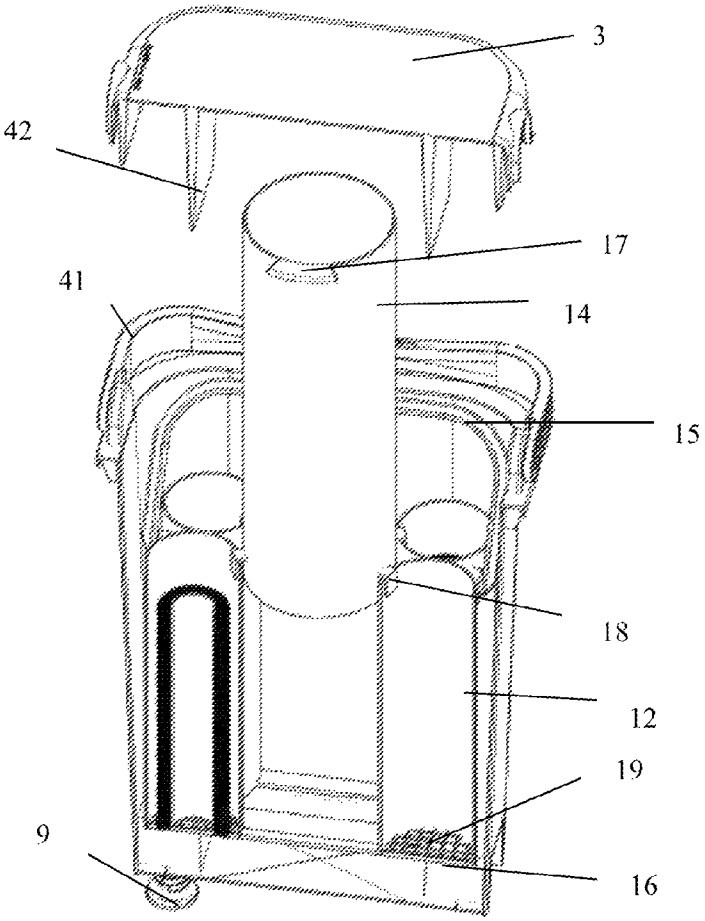
FIG. 26 is a partial cross sectional view along one side of the paint roller cleaning apparatus of FIG. 16 with the cover removed and the central compartment in its extended working position.
Figure 25:
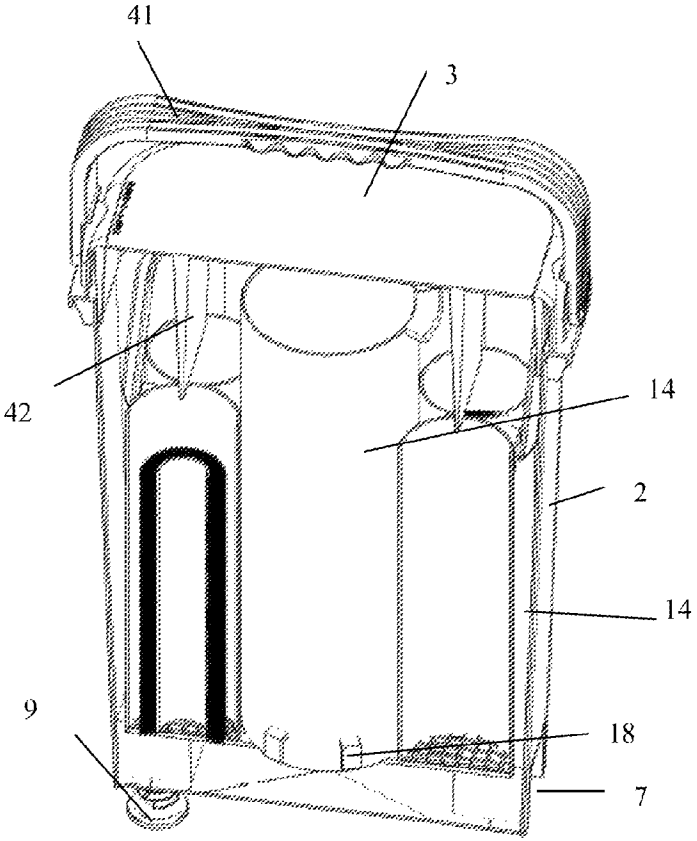
FIG. 25 is a partial cross sectional view along one side of the paint roller cleaning apparatus of FIG. 16 with the cover attached.
Figure 28:
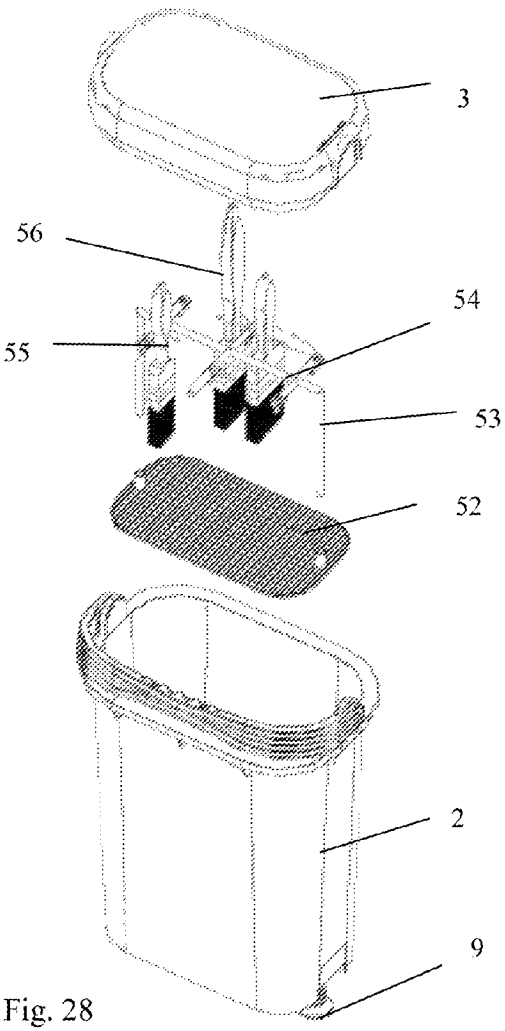
FIG. 28 is an exploded view of the paint roller cleaning apparatus of FIG. 27.
Figure 27:
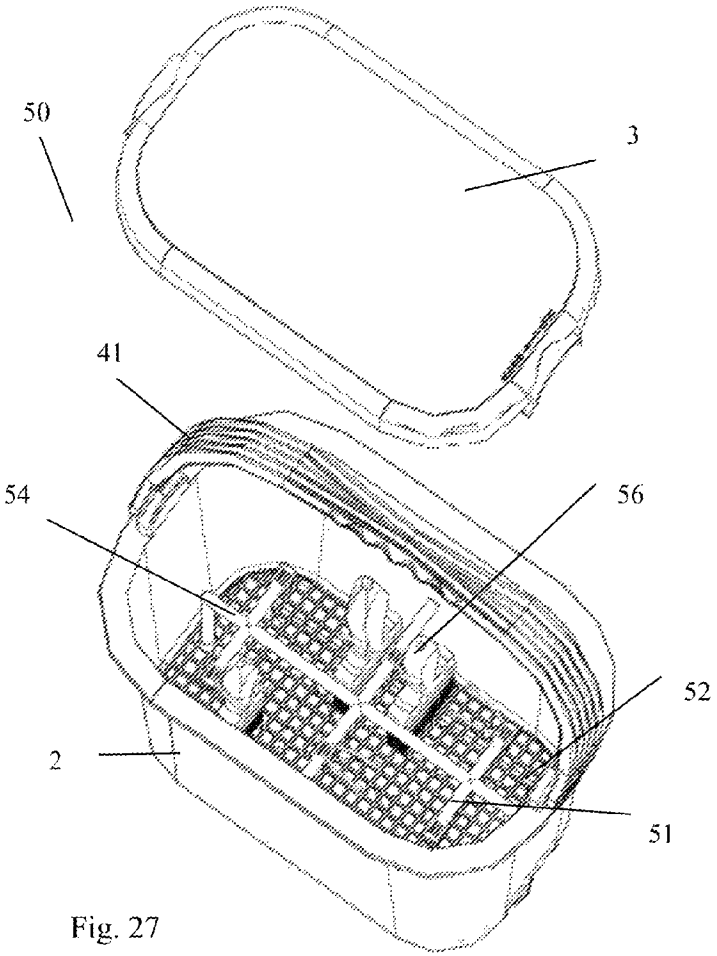
FIG. 27 is a top perspective view of a paint brush cleaning apparatus according to another embodiment of the invention showing inside the container/drum, removable cover and removable section.
Figure 29:
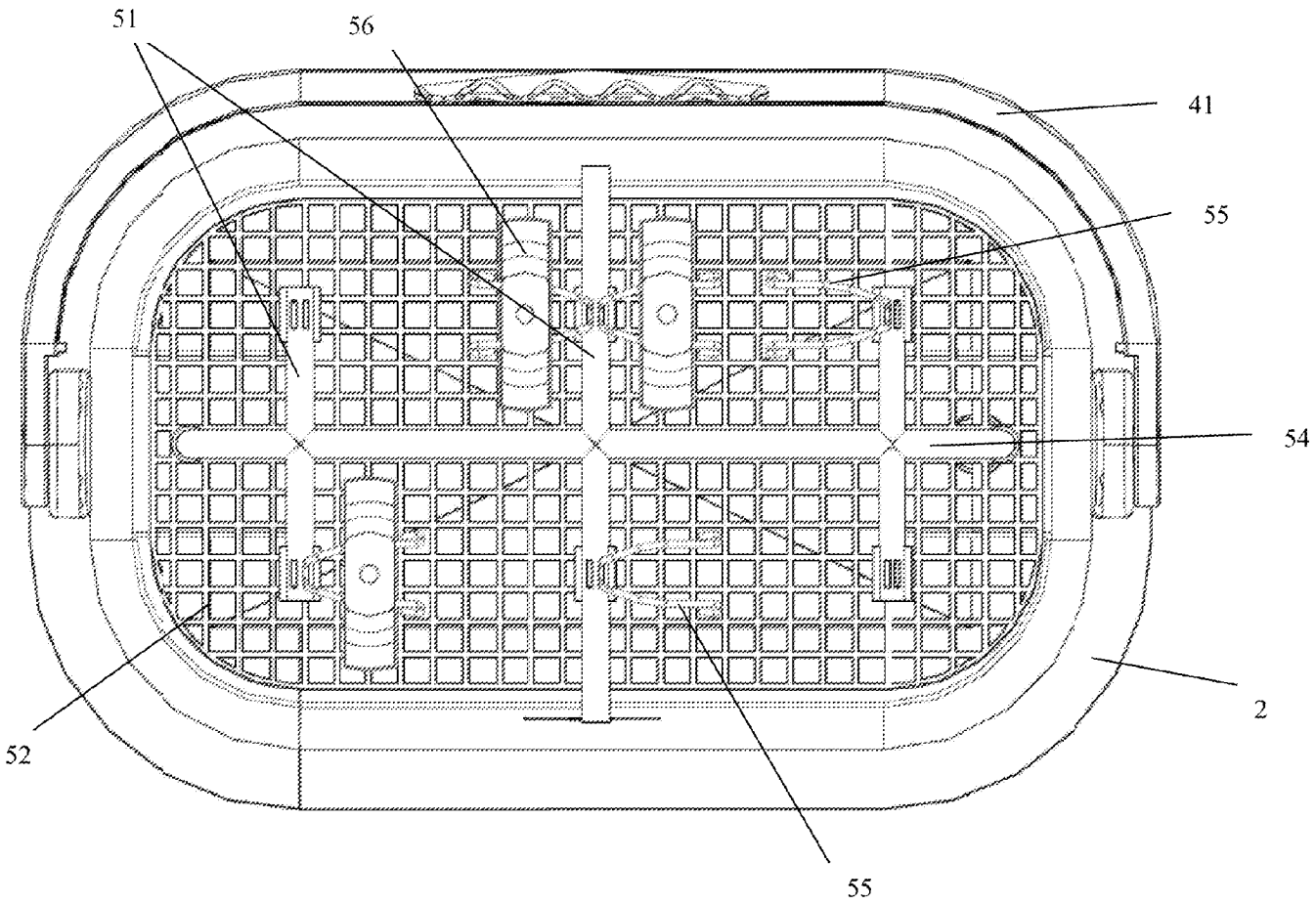
FIG. 29 is a downward view of the inside of the paint brush cleaning apparatus of FIG. 27.
Figure 30:
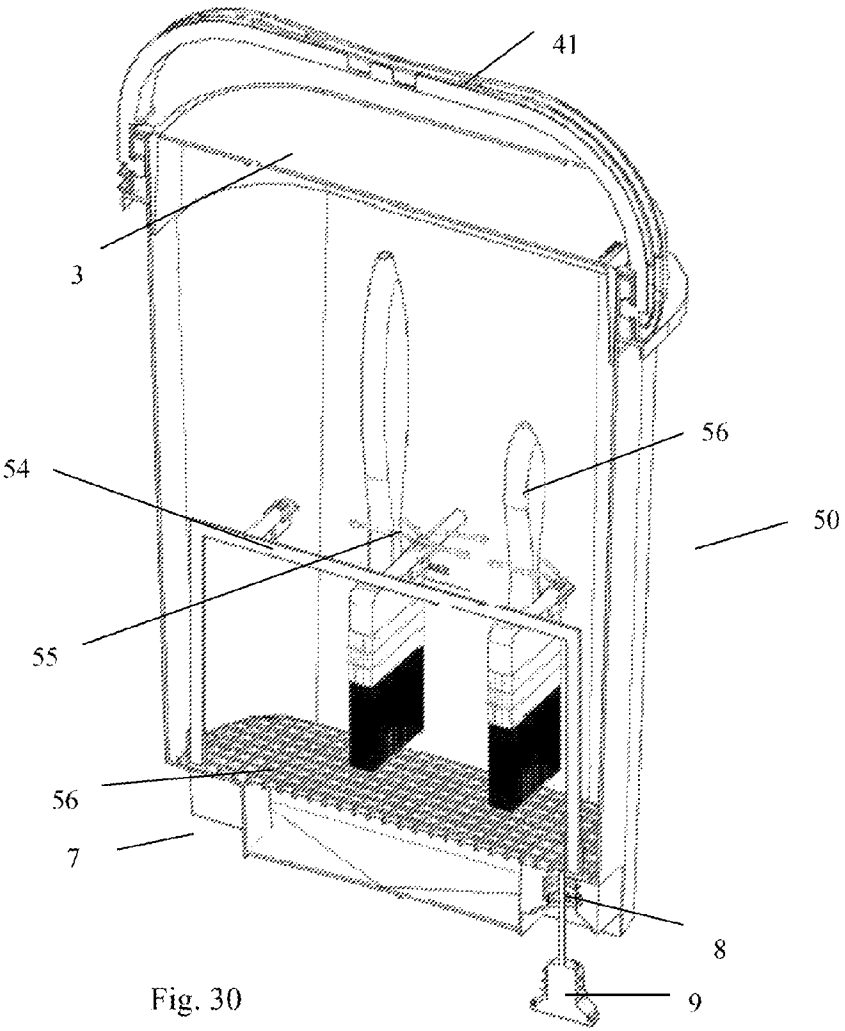
FIG. 30 is a partial cross sectional view along the width of the paint brush cleaning apparatus of FIG. 27 with the cover attached to the drum.

In this embodiment the retaining means on the cover section 3 as shown in FIG. 21 comprises two flange like projections 42 for pressing down on the outer compartments 12 on either side of the central compartment 14 keeping the outer compartments 14 and the roller sleeves 13 therein immersed in cleaning liquid. The central compartment 14 is brought to an extended position by pulling on lip 17. The compartment is kept in its extended position by clips 18 which clip across the upper rim of the outer compartments 12.

In many instances a painter needs to transport their equipment to a new location and the paint roller cleaning apparatus 1, 30, 40 of the present invention may be easily and securely transported as the cover section 3 provides a water tight seal on the drum 2. The secure cover 3 prevents paint odours and fumes from circulating in areas where the paint roller sleeves are being cleaned. It also prevents any accidental spillage or evaporation of the cleaning liquid during use and/or during transport of the apparatus.

No time is wasted cleaning and rinsing paint roller sleeves. Using the apparatus of the present invention paint laden roller sleeves are simply inserted into the cleaning liquid and left for a number of hours or overnight while the paint drops off the roller sleeves and gravity ensures the paint sludge to sediment and gather at the bottom of the drum 2.

Using the apparatus of the invention a plurality of paint roller sleeves may be cleaned at any one time. A paint laden roller sleeve may also be inserted in the central compartment of apparatus 1, 30 and 40, if all the outer compartments are occupied. The roller sleeve within the central compartment is not overly disturbed when the central compartment or the inner sleeve of the central compartment is extended to spin dry a clean roller sleeve.

The apparatus of the invention may also comprise a detachable retaining member. The retaining member may be detachably attached to the top of the removable frame. The detachable retaining member may be easily removed to insert or remove a roller sleeve from the compartments.

FIGS. 27 to 30 show a paint brush cleaning apparatus 50 according of the invention. The apparatus 50 is substantially similar to apparatus 40 and similar components are identified by the same reference numerals. The apparatus 50 has an open top watertight drum 2 and detachable cover 3. The apparatus 50 has a removable section comprising a grid-like base 52 supporting a detachable inverted substantially U shaped bar 53. The horizontal part of the bar 54 comprises a number branches 51 having a plurality of engaging means 55 for embracing the stem of a paint brush 56. Similar to apparatus 40 the drum 2 has recesses 7 in the base of the drum 2 on which the removable section is supported and kept above the base of the drum. A drain outlet 8 and bung 9 are located in the roof of one of the recesses. The cover 3 is secured to the drum 2 using the handle 41 as described before for apparatus 40.

The apparatus 50 of the invention is designed to accommodate any size of standard commercially available paint brush. Different sized paint brushes may be cleaned at the same time. The apparatus may accommodate at least two or more paint brushes. The engaging means comprises a wrap-around or holding clip 55 which embraces the stem of a paint brush 56. Any other suitable engaging means may be used. Paint laden brushes are attached to the holding clip 55 on the branches 51 of the horizontal part of the bar 54 and the paint brushes immersed in the cleaning liquid contained in the drum. The horizontal part of the bar 54 embracing the stem of a paintbrush 56 is not immersed in the cleaning liquid. Over a number of hours the paint passively falls off the brushes, through the grid-like base and gathers in the form of paint sludge at the bottom of the drum. The combination of separation and gravity results in removing paint from the paint brushes leaving clean paint brushes for re-use.

As described for apparatus 40 the cleaning liquid may be drained from the drum 2 by opening the threaded bung 9 and releasing the liquid in a controlled manner through drain outlet 8 without disturbing the paint sludge which has sedimented or gathered on the base of the drum. The remaining paint sludge on the base may be then scooped out.

Any suitable material may be used to manufacture the apparatus of the present invention. The material needs to be suitable for prolonged use with water or other solvent cleaners. It should also be easy to clean and durable. Suitable materials include polymer plastics such as for example 3 mm polymer plastic, polypropylene or any suitable comparable material.

When not in use for cleaning roller sleeves the apparatus of the invention without liquid present may be used to store a plurality of roller sleeves in the vertical compartments.

The apparatus of the present invention provides the capability of extending the useful life of a paint roller sleeve by preserving used paint roller sleeves and rejuvenating them for further use. The life of paint brushes may also be prolonged using the apparatus of the invention.

The invention is not limited to the embodiments herein before described which may be varied in detail.

Having described the invention, the following is claimed:

1. An apparatus for cleaning paint roller sleeves comprising:

an open top drum having a base and side walls for holding a quantity of liquid;

a detachable cover for sealing said open top drum; and a removable section comprising a plurality of vertical substantially cylindrical compartments for receiving paint roller sleeves and having a central vertical substantially cylindrical compartment, wherein the removable section comprises a grid-like or perforated base and wherein the base of the removable section is positioned above the base of the drum.

2. An apparatus as claimed in claim 1 wherein the central cylindrical compartment is independent of the other cylindrical compartments.

3. An apparatus as claimed in claim 1 wherein the central cylindrical compartment is higher in height than the other cylindrical compartments of the removable section.

4. An apparatus as claimed in claim 1 wherein the vertical compartments are sized to accommodate a paint roller sleeve and are longer in length than a paint roller sleeve.

5. An apparatus as claimed in claim 1 wherein the detachable cover comprises retaining means for retaining paint roller sleeves in the cylindrical compartments immersed in liquid and wherein the retaining means comprises a collar or flange projecting from the base of the detachable cover.

6. An apparatus as claimed in claim 5 wherein the retaining means comprises a detachable retaining member.

7. An apparatus as claimed in claim 1 wherein the detachable cover comprises means for securing the cover to the drum and wherein the detachable cover is secured to the drum by a snap on connector.

8. An apparatus as claimed in claim 1 wherein the base of the removable section comprises legs wherein the base of the removable section is positioned above the base of the drum wherein the base of the open top drum is recessed providing a ledge on the inner side of the drum for supporting the removable section above the base of the drum.

9. An apparatus as claimed in claim 1 wherein the removable section comprises a handle for inserting and removing the section from the drum and wherein the handle is not in contact with the liquid contained in the drum.

10. An apparatus as claimed in claim 1 which is portable and comprises handle means for lifting and transporting the apparatus and wherein there are caster wheels on the base of the drum.

11. An apparatus as claimed in claim 1 wherein the central cylindrical compartment comprises a protruding lip on its upper edge for pulling the central compartment into an extended position.

12. An apparatus as claimed in claim 1 wherein the central cylindrical compartment comprises means to releasably attach the central compartment to the other cylindrical compartments when in its extended position.

13. An apparatus as claimed in claim 12 wherein the central cylindrical compartment comprises clips at its lower end which clip onto the upper edge of an outer compartments.

14. An apparatus as claimed in claim 1 wherein the central cylindrical compartment is telescopic wherein the central cylindrical compartment comprises an inner and outer sleeve and wherein the inner sleeve of the central vertical compartment is extendable to a working position.

15. An apparatus as claimed in claim 14 wherein the inner sleeve of the central vertical compartment comprises a protruding nib and wherein the outer sleeve of the central vertical compartment comprises a groove for receiving the protruding nib on the inner sleeve guiding the inner sleeve from a resting position to an extended working position.

16. An apparatus as claimed in claim 1 wherein the drum comprises a drain outlet wherein the drain outlet is located on or near the base of the drum or located in the roof of a recess on the base of the drum and wherein the drain outlet comprises a bung or stopper.

17. A method for cleaning paint soaked roller sleeves using an apparatus as claimed in claim 1 comprising the steps of:

inserting paint laden roller sleeves into the vertical cylindrical compartments of the removable section;

filling the drum with sufficient cleaning liquid;

immersing the removable section in the cleaning liquid;

securing the detachable cover to the drum;

leaving the roller sleeves for several hours in the drum to allow the paint to drop off the roller sleeves through the grid-like base of the removable section and sediment at the bottom of the drum;

removing the detachable cover; and removing the clean roller sleeves from the vertical compartments.

18. A method as claimed in claim 17 wherein the central cylindrical compartment comprises a protruding lip for pulling the central compartment into an extended position and a clean roller sleeve is spun dry in the central vertical compartment when in its extended working position wherein the clean roller sleeve is spun dry in the central compartment using a conventional roller sleeve spinner and wherein the liquid spun off the roller sleeve is retained in the drum.

19. An apparatus comprising:

an open top drum having a base and side walls for holding a quantity of liquid;

a detachable cover for sealing said open top drum; and a removable section comprising a grid-like base supporting a detachable inverted substantially U shaped bar, a horizontal part of the bar comprising a plurality of engaging means for embracing the stem of a paint brush.

20. An apparatus as claimed in claim 19 wherein the engaging means comprises wrap-around or holding clips which embrace the stem of a paint brush wherein the horizontal part of the bar of the removable section is not immersed in cleaning liquid and wherein the grid-like base of the removable section is positioned above the base of the drum.

21. A method for cleaning paint laden paint brushes using an apparatus as claimed in claim 19 comprising the steps of:

attaching paint laden paint brushes onto the engaging means of the substantially U shaped bar of the removable section;

filling the drum with sufficient cleaning liquid;

immersing the removable section in the cleaning liquid wherein the horizontal part of the bar is not in contact with the cleaning liquid; and leaving the paint brushes for several hours in the drum to allow the paint to drop off the brushes through the grid-like base of the removable section and sediment at the bottom of the drum.

* * * * *